US005123233A

United States Patent [19]

Majewski

[11] Patent Number: 5,123,233

[45] Date of Patent: Jun. 23, 1992

[54] LEG AND CALF PROTECTOR PADS, SADDLE

[76] Inventor: Virginia C. Majewski, 32 Treasure Ave., Kensington, Conn. 06037

[21] Appl. No.: 617,530

[22] Filed: Nov. 23, 1990

[51] Int. Cl.[5] ..... B68C 1/20

[52] U.S. Cl. ..... 54/46

[58] Field of Search ..... 54/23, 44, 46, 65

[56] References Cited

U.S. PATENT DOCUMENTS

| | | | |
|---|---|---|---|
| 592,587 | 10/1897 | Hollister | 54/46 |
| 950,678 | 3/1910 | Reisacher | 54/46 |
| 1,112,708 | 10/1914 | Littlefield | 54/23 |
| 3,323,286 | 6/1967 | LeLaurin, Jr. | 54/44 |
| 3,371,467 | 3/1968 | Salisbury, III | 54/44 |
| 3,466,852 | 9/1969 | Stoner | 54/65 |
| 3,807,136 | 4/1974 | Deal | 54/44 X |
| 3,828,521 | 8/1974 | Dulaney | 54/23 |
| 4,179,869 | 12/1979 | Horst et al. | 54/46 |
| 4,502,266 | 3/1985 | Friedson | 54/44 |

FOREIGN PATENT DOCUMENTS

| | | | |
|---|---|---|---|
| 9110 | of 1887 | United Kingdom | 54/44 |

*Primary Examiner*—Robert P. Swiatek
*Assistant Examiner*—Nicholas D. Lucchesi

[57] ABSTRACT

A method and apparatus are disclosed for preventing blisters, irritations, sores, and possible scarring caused by the saddle flap and stirrup leathers pinching the skin of an individual's bare legs and calf portions thereof while riding horseback on an English saddle. The leg and calf protector pads are constructed from a synthetic pile fabric by attaching together two selective portions of the fabric in a back-to-back relationship. The leg and calf protector pads are placed on the stirrup leather, and the stirrup leather buckles are fastened by a buttonhole on the leg and calf protector pads. A nylon strap is placed on the stirrup saddle bar for a fastener.

2 Claims, 3 Drawing Sheets

LEG AND CALF PROTECTOR PADS, SADDLE

SUMMARY OF THE INVENTION

My invention will prevent occurrence of blisters, sores, irritations, scarring, and bacterial disease on a horseback rider's bare legs and calf portions thereof. I have observed while using the leg and calf protector pads that it also facilitates healing of existing sores on the legs and calf portions thereof. I have constructed the leg and calf protector pads using a synthetic pile fabric with a thin, flexible backing layer. The pads are constructed by attaching together two selectively sized portions of the fabric in a back-to-back relationship. I place the tubular constructed part of the leg and calf protector pads on the saddle's stirrup leather with the stirrup bar closed, and the tubular constructed section is attached to the stirrup leather buckle by means of a buttonhole in the tubular portion.

DESCRIPTION OF THE PREFERRED EMBODIMENT

Figure 1:
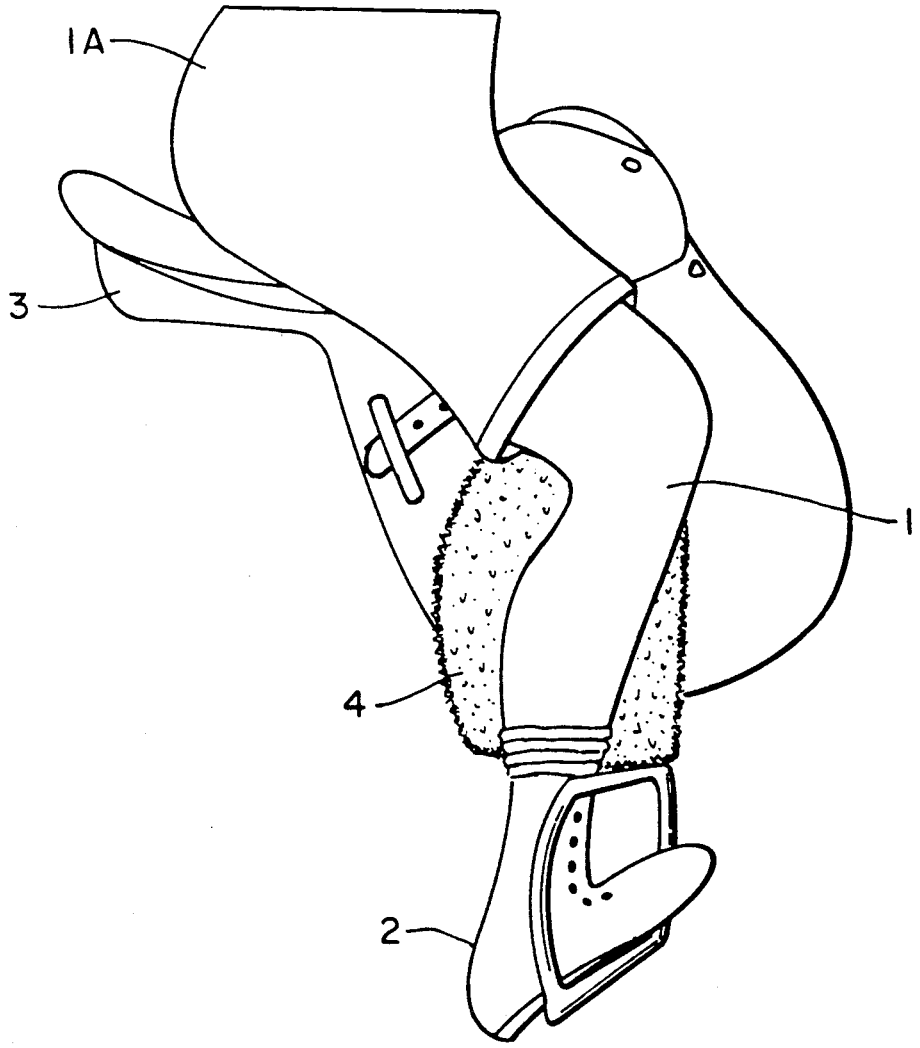
FIG. 1 is a side elevation of an individual in an English saddle in short pants.
Figure 2:
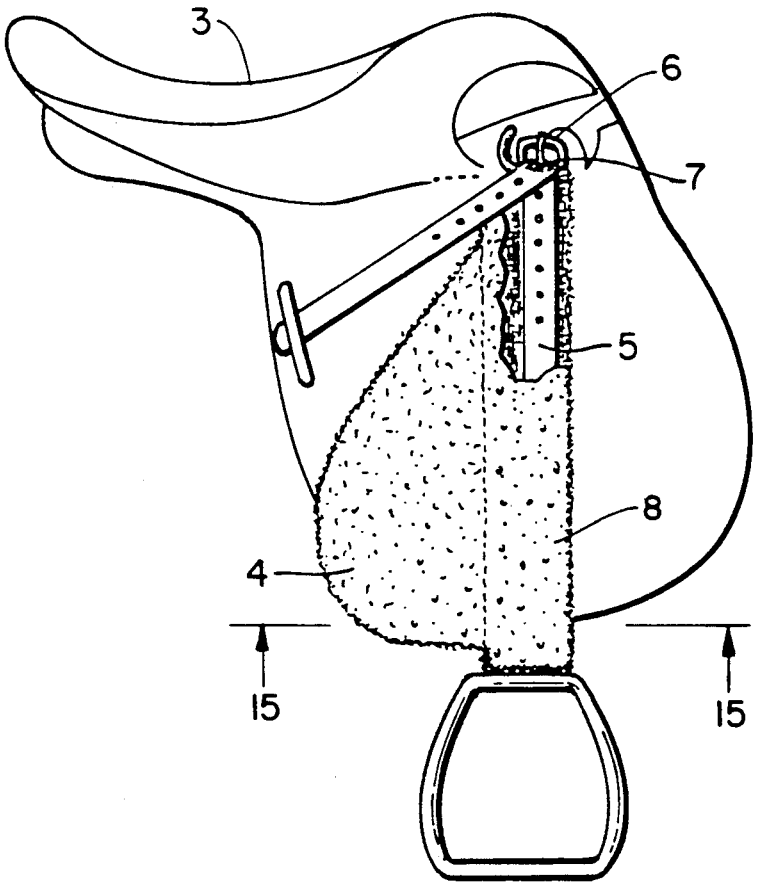
FIG. 2 is a side view of my invention in place on the saddle's stirrup leather buckle.

Referring now tot he drawings wherein like reference numerals are used throughout the several views to indicate like elements of structure, there is disclosed in FIG. 1 a person 1 from the waist down wearing paddock boots/shoes 2, sitting or riding in an English saddle 3 in short pants 1A viewed in a side elevation. FIG. 2 indicates my invention, the leg and calf protector pads 4 on the stirrup leather 5 and buckled 6 with a fastening method to the buttonhole 7 of the leg and calf protector pads 4. Further details are disclosed in FIGS. 2–5. The leg and calf protector pads 4 are constructed from a synthetic pile, using any color of fabric, having a thin, flexible backing layer. This entirely synthetic fabric will not support bacterial growth, is resistant to wear, and is machine washable with no adverse effects on performance of the pads 4. Other materials may be used, such as wools, furs, sheep and lamp skin, or pelts.

Figure 3:
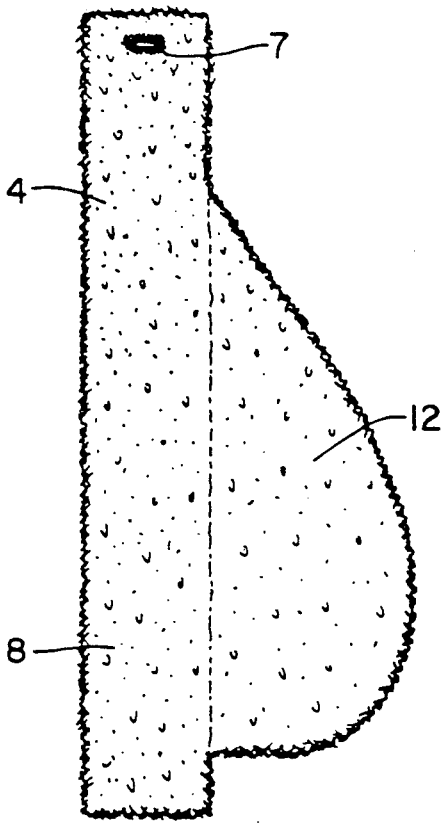
FIG. 3 is a side view of the Leg and Calf Protector Pad.
Figure 4:
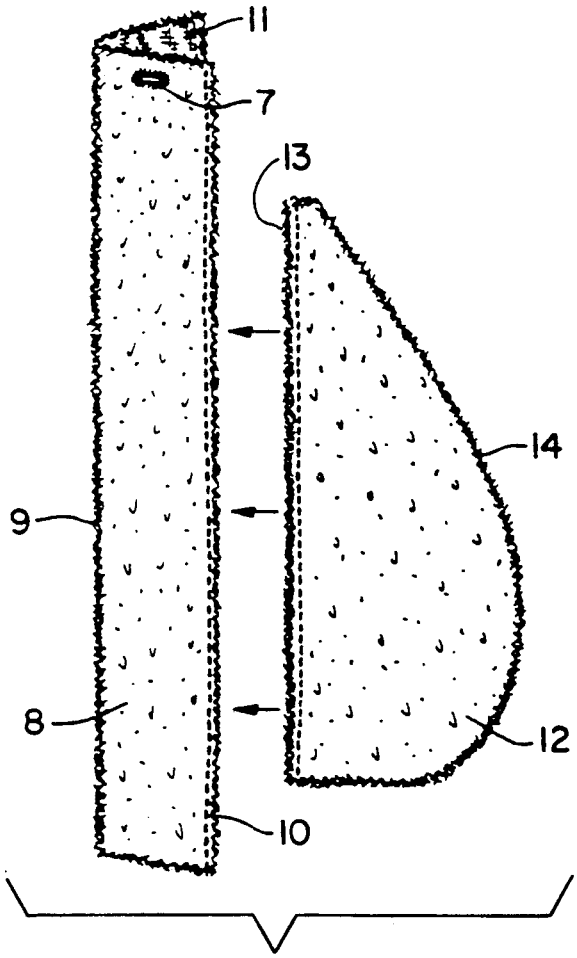
FIG. 4 is a side view of the Leg and Calf Protector Pad separated at the seam in detail method of construction.
Figure 5:
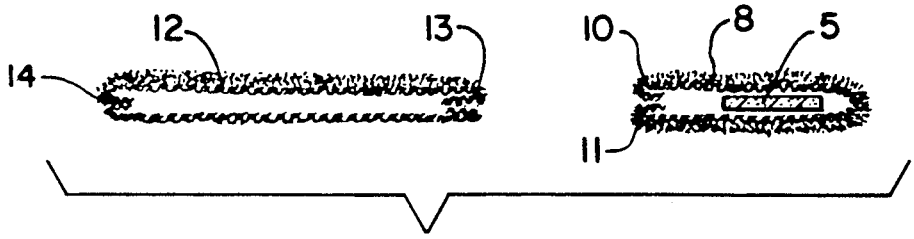
FIG. 5 is a bottom sectional view taken along line 15—15 of FIG. 2.

To construct the leg and calf protector pads of the generally vertical tubular type shown in FIG. 3–5, the tubular structure 8 of the fabric is folded over along a fold line 9 forming two edges 10 and 11 at the opposite of the fold line 9. This part of the leg and calf protector pad is made up of a selectively sized piece of polyester fiber pile layer fabric which is folded in to a back-to-back layer relationship with the two pile layers extending in opposite directions FIG. 4, 10 and 11. The two side edges FIG. 4 and 5, 10 and 11 are folded to make a selective size hem and then each item is stitched. The buttonholes 7 can the be selectively constructed at the top portion of one side of the tubular constructed section of the leg and calf protector pad. It is in this part of the pattern of my invention, the leg and calf protector pad, that the stirrup leather and buckle pass up through the tubular structure part FIG. 2, 5 and 8 of the pad to the buttonhole 7 where the buckle is fastened to the pad. In order to construct the calf part of the pad 12, two selectively sized portions of fabric synthetic pile in a back-to-back relationship are required. All edges of the calf portion of the pad are sewn except for the vertical sides FIG. 4, 13. Other sides 14 are sewn together and then turned inside out so that the stitching is on the inside 14. To close the open ends FIG. 4, 10, 11 and 13 that would form the tubular construction part, connected with the calf part 12, it is necessary to open the side part of the tubular construction 10 and 11 on the opposite end of the fold. Then the calf part of the constructed pad edges 13 would be placed inside the tubular constructed part 10 and 11 at the opposite end of the fold 9 in a selective position according to the selective size of the stirrup leathers FIG. 2, 5 and then sewn together FIG. 4, 10, 11 and 13 so that dotted lines meet dotted lines to form the leg and calf protector pads.

What is claimed is:

1. A method of protecting a horseback rider's legs, said method comprising the steps of:

a. providing a stirrup leather protector pad, said pad comprising a tubular section of protective material, said pad having a buttonhole at the upper portion thereof;

b. attaching said pad to a stirrup leather of a riding saddle, said attaching step comprising the sub-steps of:

c. sliding a stirrup leather buckle and said stirrup leather through said tubular section of said pad so that said pad encircles and substantially covers said stirrup leather;

d. attaching said stirrup buckle to said buttonhole of said pad so that said pad is secured to said stirrup leather.

2. The method of protecting a horseback rider's legs as recited in claim 1 wherein said method further comprises the step of forming said pad out of a material selected from the group consisting of synthetic pile fabrics, wools, furs, sheepskin, lambskin, pelts, acrylic, or cotton blends.

* * * * *